US005788606A

United States Patent [19]

Rich

[11] Patent Number: 5,788,606

[45] Date of Patent: Aug. 4, 1998

[54] ADJUSTABLE TRAMPOLINE SUPPORT

[76] Inventor: Rolland Wayne Rich, P.O. Box 3828, Albany, Ga. 31706-3828

[21] Appl. No.: 595,242

[22] Filed: Feb. 1, 1996

[51] Int. Cl.[6] ..... A63B 7/02

[52] U.S. Cl. ..... 482/27; 482/43; 482/69

[58] Field of Search ..... 5/89.1, 84.1, 85.1, 5/83.1, 81.1 R; 482/43, 27, 69

[56] References Cited

U.S. PATENT DOCUMENTS

| | | | |
|---|---|---|---|
| 924,075 | 6/1909 | Johnson | 5/84.1 |
| 2,990,899 | 7/1961 | Bella | 5/83.1 |
| 3,506,985 | 4/1970 | Lang | 5/85.1 |
| 4,340,215 | 7/1982 | Murphy | 482/43 |
| 4,449,716 | 5/1984 | Goldy et al. | 42/43 |
| 5,221,241 | 6/1993 | Bare, II | 482/27 |
| 5,577,984 | 11/1996 | Bare, II | 482/43 |

FOREIGN PATENT DOCUMENTS

| | | | |
|---|---|---|---|
| 58119 | 8/1899 | Germany | 5/85.1 |
| 498916 | 5/1930 | Germany | 5/84.1 |
| 1416190 | 8/1988 | U.S.S.R. | 482/43 |

OTHER PUBLICATIONS

Advertisement brochure entitled "Get Attached To The Trampoline Thing™," dated 1993 by S&S Sports, Inc.

*Primary Examiner*—Jerome Donnelly

*Attorney, Agent, or Firm*—Finnegan, Henderson, Farabow, Garrett & Dunner, L.L.P.

[57] ABSTRACT

A trampoline system including a trampoline having a frame and an adjustable support for supporting a user of the trampoline. The support includes a tower adjustable to the dimensions of the frame and a harness attached to the tower for carrying the user. The height of the tower adjusts to accommodate the size of the user.

20 Claims, 5 Drawing Sheets

ADJUSTABLE TRAMPOLINE SUPPORT

FIELD OF THE INVENTION

The present invention relates to an adjustable trampoline support, and more particularly to a trampoline support that includes a tower that adjusts in both the width and height dimensions to fit any size trampoline and support any size user for a safer and more enjoyable use of the trampoline.

DESCRIPTION OF THE PRIOR ART

Trampolines and other springboards have been used for decades for sport, entertainment, and fitness purposes. Significant health risks, however, accompany the use of a trampoline. For instance, should the user lose control, he or she may land incorrectly on the trampoline or, even worse, fall off the trampoline causing significant injuries. For this reason, a number of persons often surround the trampoline to "spot" the user should control be lost.

In many gymnasiums, a rope/pulley system is used to spot the trampoline user. In such a system, pulleys attach to the ceiling above a trampoline. A rope connects at one end to a harness carrying the user, loops around the pulley, and is held at the other end by a "spotter." Should the user appear to be about to land incorrectly or fall off the trampoline, the spotter pulls the user upwards. This, however, requires keen attention and high strength of the spotter. In addition, the trampoline must always be placed directly under the pulleys, limiting the portability of the trampoline.

Another device, called The Trampoline Thing™, has been used in conjunction with a trampoline for fun and exercise. This device incudes two poles opposite one another at the sides of a trampoline. Cords connect at one end to the top of each pole and at the other end to a harness supporting a trampoline user. The Trampoline Thing™, however, is designed to fit a 14'×14' octagon shaped trampoline, requires a ceiling clearance of 26' and weighs 850 pounds. The size and high costs of this device make it unsuitable for home use. The weight of the device limits its portability. In addition, The Trampoline Thing™ is not adjustable to fit any size trampoline or any size user.

In light of the foregoing, there is a need for a low cost trampoline system that adjusts to fit any size trampoline and support any size user, and is portable, safe, and does not require spotters.

SUMMARY OF THE INVENTION

Accordingly, the present invention is directed to an adjustable trampoline support that substantially obviates one or more problems due to limitations and disadvantages of the prior art.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the written description and appended claims as well as the appended drawings.

To achieve the objects and in accordance with the purpose of the invention, as embodied and broadly described herein, the invention provides a trampoline system including a trampoline having a frame, and an adjustable support for supporting a user of the trampoline. The support has a tower adjustable to the dimensions of the frame and a harness attached to the tower for carrying the user.

In another aspect, the height of the tower of the above trampoline system adjusts to accommodate the size of the user.

In a further aspect, the invention provides an adjustable support for carrying a user of a trampoline. The support includes a tower having a top, a bottom, and a pair of sides. The top and the bottom are adjustable to the dimensions of the trampoline. A harness attaches to the top of the tower for carrying the user.

In yet another aspect, the invention provides an adjustable support for carrying a user of a trampoline. The support includes a tower having a top portion and a pair of sides. The height of the pair of sides adjusts to accommodate the size of the user. A harness connects to the top portion for carrying the user.

It is to be understood that both the foregoing general description and the following detailed description are exemplary and explanatory only and are not restrictive of the invention as claimed.

The accompanying drawings, which are incorporated in and constitute a part of this specification, illustrate one embodiment of the invention and together with the description, serve to explain the principles of the invention.

DESCRIPTION OF THE PREFERRED EMBODIMENT

Reference will now be made in detail to the present preferred embodiment of the invention, an example of which is illustrated in the accompanying drawings. Wherever possible, the same reference numbers will be used throughout the drawings to refer to the same or like parts.

The trampoline system of the present invention includes a conventional trampoline and frame. The frame lies underneath and supports the trampoline. An adjustable support attaches to the frame for carrying the trampoline user. The support includes a tower that adjusts in the width dimension to fit the dimensions of any size trampoline and frame. The tower also adjusts in the height dimension to accommodate the size of the user. The tower, therefore, can be retrofitted to existing trampolines for enjoyment by small children to large adults. The support also includes a harness for carrying the user. The tower supports the harness by flexible cords and rope.

The design of the adjustable support allows for low cost of manufacture and ease of shipping, construction, and handling, increasing the portability of the support. As important, the adjustable support according to the present invention eliminates the need for spotters. Because the user is carried in a harness and support by the tower, the trampoline system according to the present invention greatly increases the safety of trampoline use.

Figure 1:
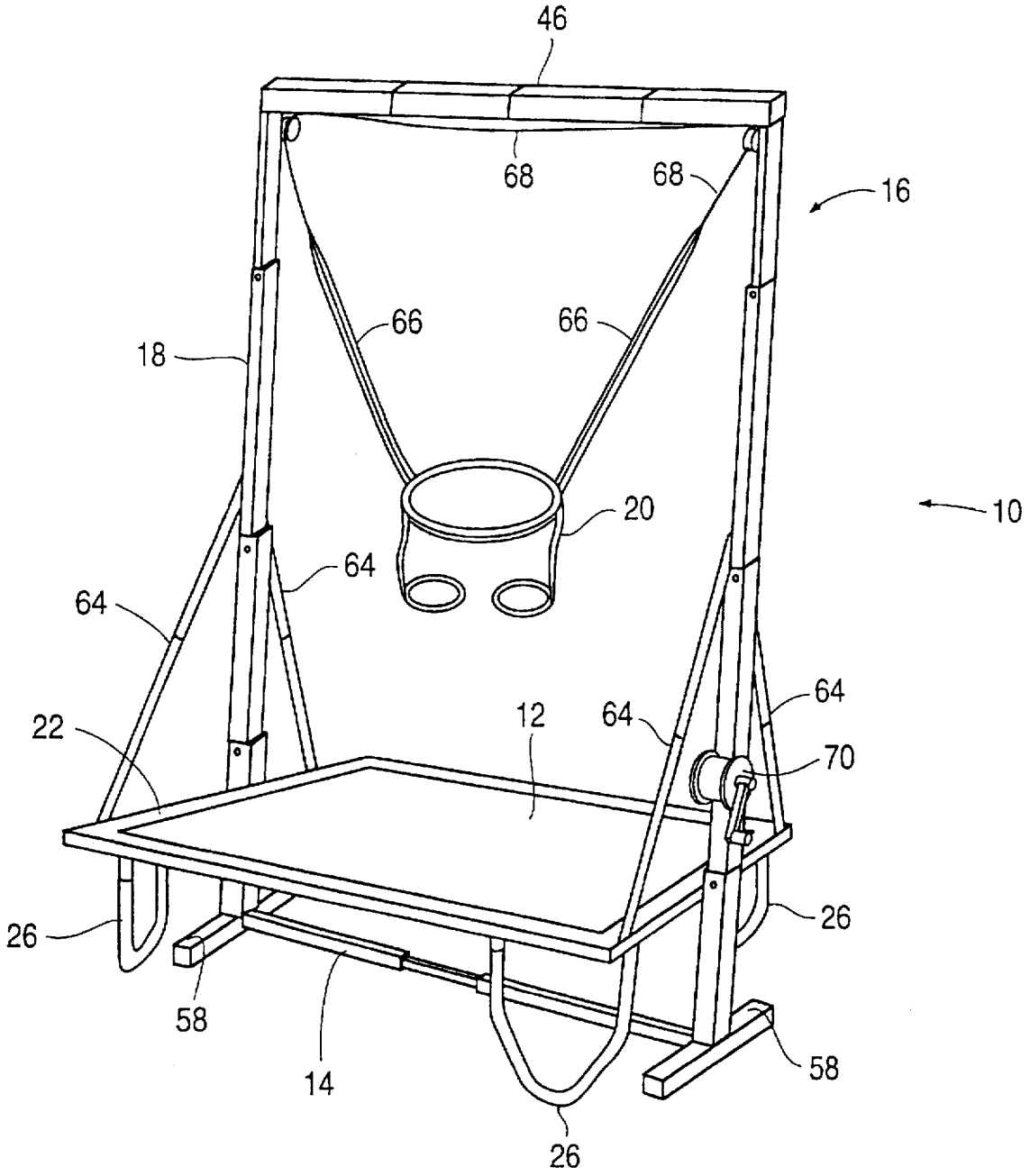
FIG. 1 is a perspective view of a trampoline system including an adjustable trampoline support according to the present invention.

As embodied herein and referring to FIG. 1, a trampoline system 10 includes as its major components a trampoline 12 having a frame 14 underneath trampoline 12, and an adjustable support 16 including a tower 18 and a harness 20. Trampoline 12 is a conventional trampoline that is readily commercially available. A soft cushion 22 surrounds trampoline 12 for added safety should the user jump or land near the edges of trampoline 12.

Figure 2A:
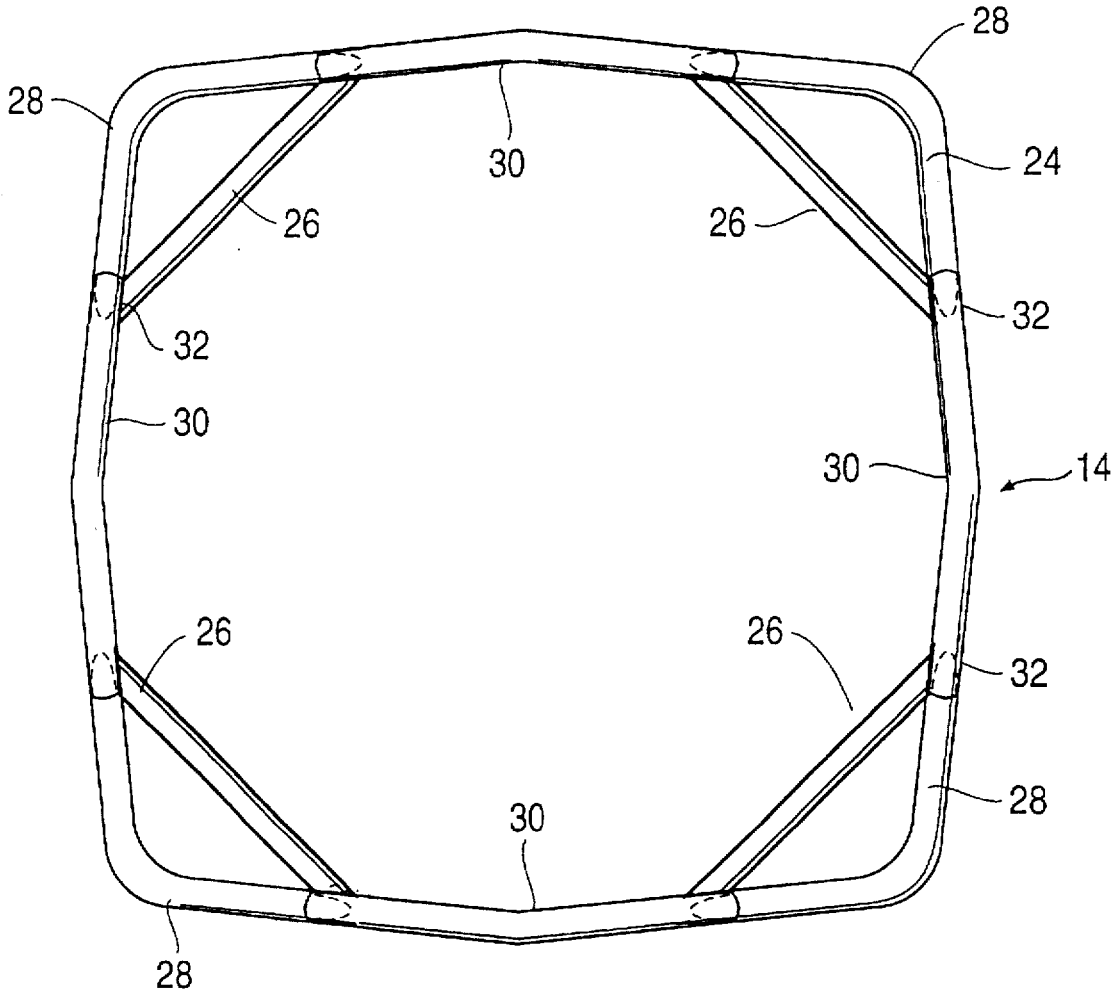
FIG. 2A is a plan view of a conventional frame for a trampoline used in the trampoline system of FIG. 1.
Figure 2B:
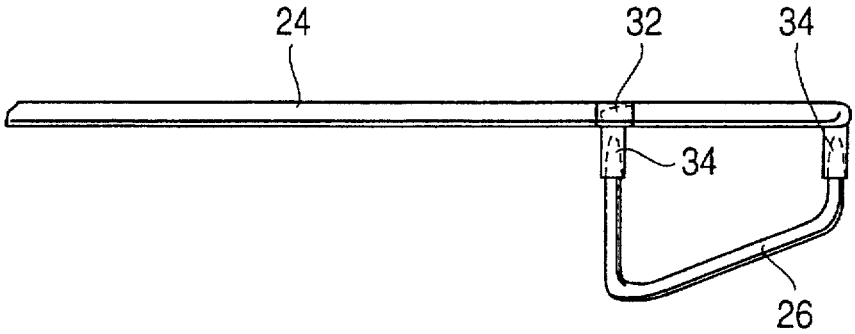
FIG. 2B is a partial side view of the frame of FIG. 2A.

The underneath frame 14, also commercially available and comprised of conventional parts and materials, supports trampoline 12. As shown in FIGS. 1, 2A, and 2B, frame 14 includes a substantially rectangular upper section 24 and four legs 26, one leg 26 at each corner of upper section 24. Upper section 24 fits the dimensions of trampoline 12 and cushion 22 and lies underneath the edges of cushion 22 to support trampoline 12. Trampoline 12 and cushion 22 may be attached to upper section 24 by any suitable means known in the art. For example, straps, made of leather, "velcro" or other high strength material, may be used to connect to trampoline 12 and cushion 22, wrap around upper section 24, and attach to corresponding buckles.

As embodied herein, frame 14 is comprised of a multipart construction, allowing easy shipment, handling, and construction. As shown in FIG. 2A, upper section 24 is constructed of four corner pierces 28 interconnected with four side pieces 30, each piece 28 and 30 preferably constructed of round, high-strength metal piping, and more preferably of zinc coated steel piping. Each corner piece 28 includes two tapered ends 32 that insert into the ends of the side pieces 30, as shown in FIGS. 2A and 2B. Each side piece 30 includes a slight angled bend at its mid-portion to compensate for the angle of each corner piece 28, which is slightly greater than 90°. Preferably, the angle of the bend of each side piece 30 is approximately 6°.

Each side piece 30 also includes a pair of leg sockets 34, as shown in FIG. 2B. Each socket 34 is welded or otherwise connected to the bottom of side pieces 30 to accept the upper portions of legs 26. The upper portions of legs 26 are also tapered for insertion into sockets 34. When legs 26 are inserted into sockets 34, the entire frame 14 will not rotate and remains sturdy and stable.

As mentioned, support 16 of trampoline system adjusts in width to the size of the trampoline and also adjusts in height to the size of the user. As embodied herein, support 16 includes tower 18 and a harness 20 to carry the trampoline user, as most clearly shown in FIG. 3. Tower 18 includes a top 36, a bottom 38, and two sides 40. For width adjustment of support 16, top 36 and bottom 38 include a plurality of telescoping pieces of tubing or piping. In the preferred embodiment, the telescoping pipes of top 36 and bottom 38 include two larger cross-section pipes 42 alternating with two smaller cross-section pipes 44. The use of telescoping piping also increases the portability of the support and eases shipping and handling.

Figure 3:
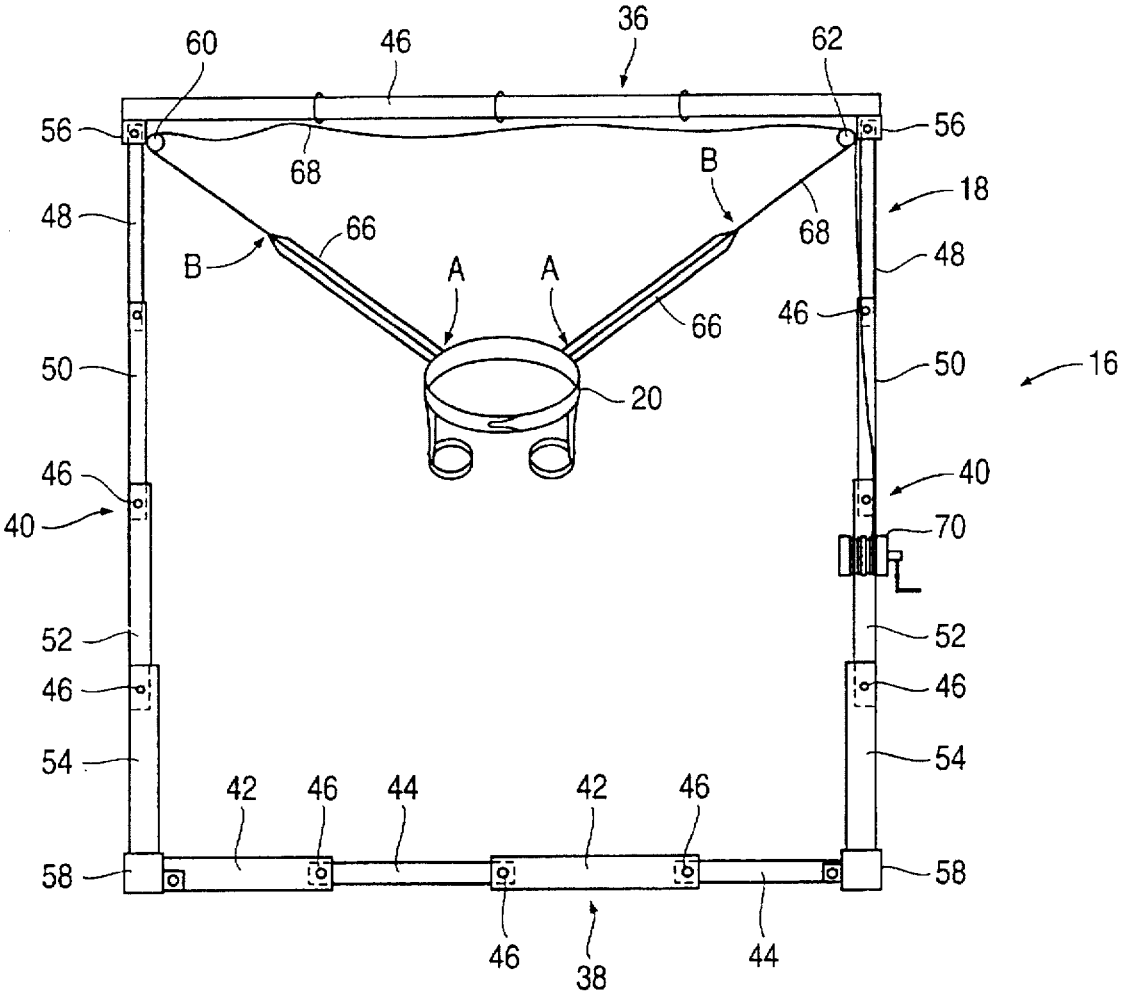
FIG. 3 is a front view of the adjustable trampoline support used in the trampoline system of FIG. 1.

As shown in FIGS. 1 and 3, a foam pad 46 covers top 36 for aesthetics and added safety should the trampoline user collide with top 36. Foam pad 46 attaches to top 36 by any suitable fastening means, for example, nylon ties.

Preferably, pipes 42 and 44 are of square cross-section, 1" and ¾" square respectively, and comprised of high strength, zinc-coated steel. Such piping is readily commercially available at relatively low cost. Other suitable dimensions, cross-sections, and materials may be used so long as high strength is maintained.

To interconnect pipes 42 and 44 and allow for variable widths of support 16, holes 46 are drilled into the ends of each pipe 42 and 44 and a bolt or pin is inserted through the aligned holes 46. To alter the width of support 16, a pin is taken out, and a smaller pipe 44 telescopes into a larger pipe 42.

The embodiment shown in FIG. 3 allows for three different support widths, one with all four pipes pulled out from one another, a second with one smaller pipe inserted into a larger pipe, and a third with both smaller pipe telescoped into the larger pipes. To fit any size trampoline, a larger number of adjustments or finer adjustments can be achieved by adding more pipes or drilling additional holes along the length of each pipe.

Each side 40, as shown in FIG. 3, includes four telescoping pieces of piping, from top to bottom designated by reference numerals 48, 50, 52, and 54, respectively ranging from the smallest cross-section to the largest cross-section. To adjust the height of tower 18, the top pipe 48 telescopes into pipe 50. In turn, pipe 50 telescopes into pipe 52, and pipe 52 telescopes into pipe 54. To interconnect the pipes of sides 40, holes 46 are drilled into the ends of each pipe and a bolt or pin is inserted through the aligned holes 46. To alter the height of tower 18, a pin is taken out and a corresponding pipe telescopes into an adjacent lower pipe. A larger number of adjustments and finer adjustments can be achieved by, once again, adding pipes or drilling additional holes along the length of the existing pipes.

As with the pipes of the top and bottom, the pipes of sides 40 are preferably comprised of square cross-section high-strength, zinc-coated steel. Preferably, the dimensions of pipes 48, 50, 52, and 54 are respectively 1¼", 1½", 1¾", and 2" square. Other suitable dimensions, cross-sections, and materials may be used so long as high strength is maintained.

Figure 4:
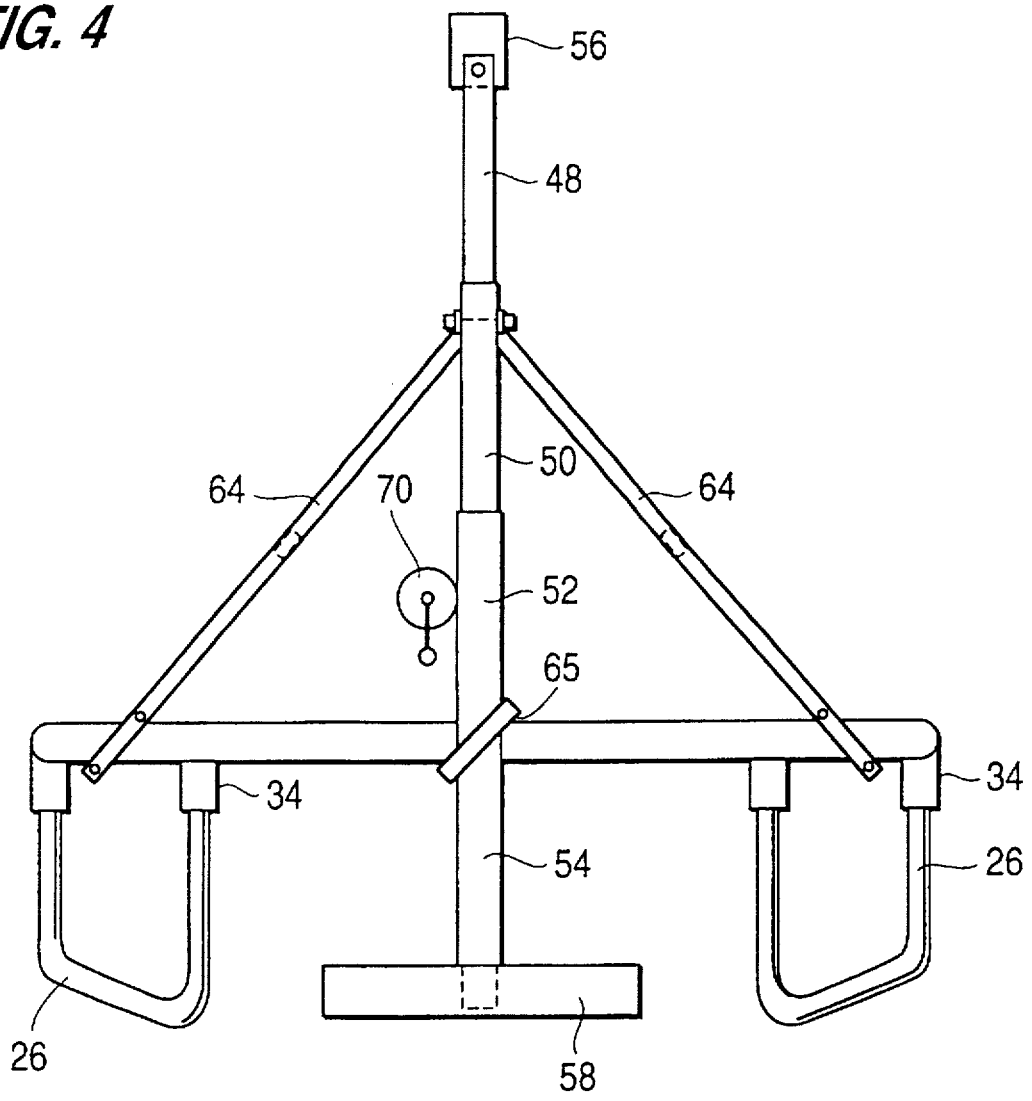
FIG. 4 is a side view of the trampoline system of FIG. 1 without a harness.

To connect sides 40 to top 36 and bottom 38, top and bottom sockets 56 attach to the ends of top 36 and bottom 38. The pipes of sides 40 insert into the sockets. FIGS. 3 and 4 show only the top sockets 36, as legs 58 connect to sides 40 and bottom 38.

Trampoline system 10 further includes two pairs of side braces 64, as shown in FIGS. 1 and 4. Side braces 64 add stability to system 10. Braces 64 connect sides 40 of tower 18 to frame 14 of trampoline 12. The top of each brace 64 secures to a side 40 via a bolt through a hole 46, for example pipe 50 as shown in FIG. 4. The bottom of each brace 64 connects to frame 14 by a U-bolt or other secure fastening means known in the art. A pair of U-bolts 65 also directly connect sides 40 to frame 14, as shown in FIG. 4. These connections provide a sturdy, stable connection between support 16 and frame 14.

As embodied herein, each brace 64 is comprised of a pair of round metal tubing preferably 1¼" in diameter. The top tube includes a tapered end for insertion into the bottom tube.

Figure 5:
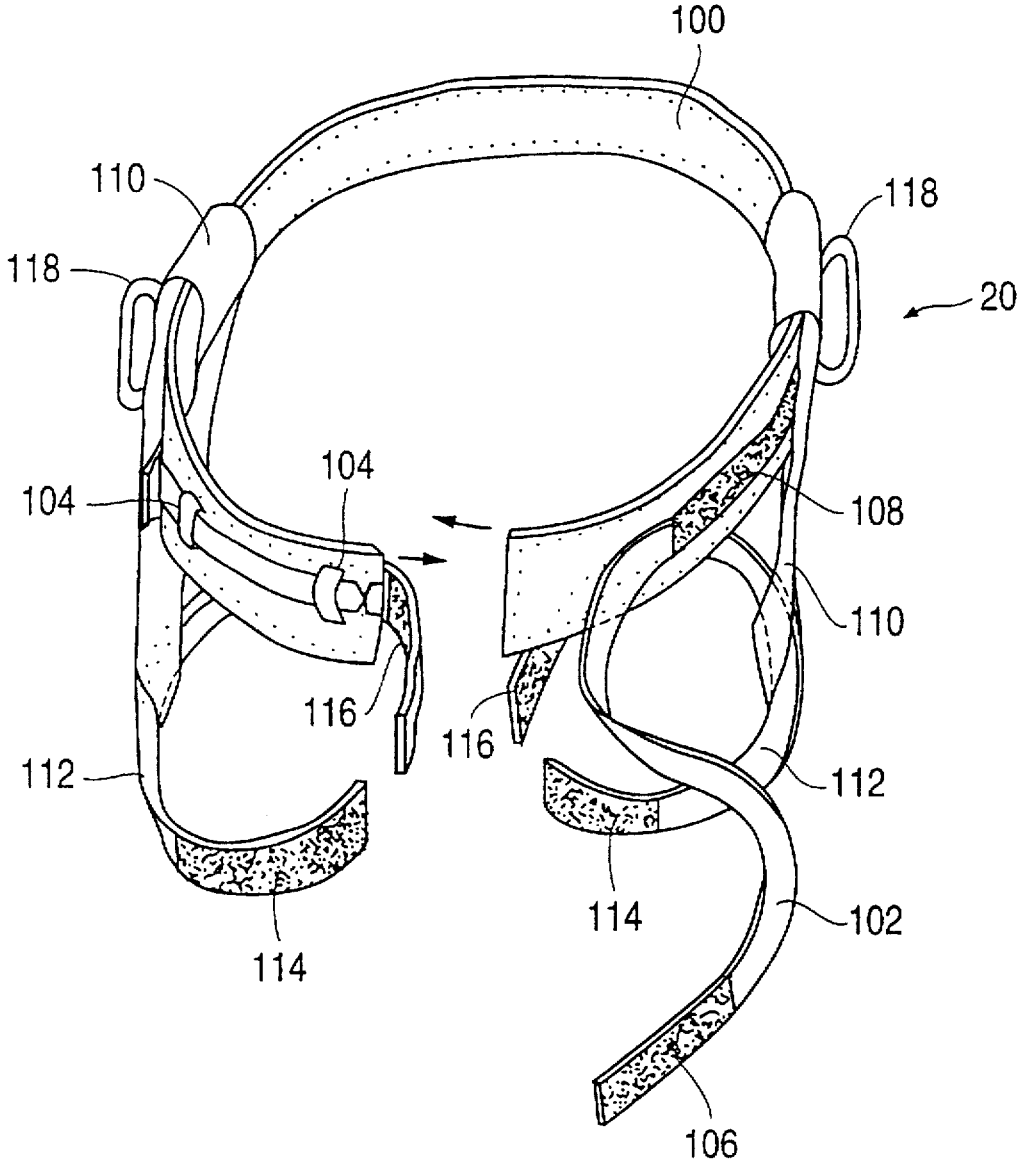
FIG. 5 is a perspective view of a harness used in the trampoline system of FIG. 1.

As shown in FIG. 5, harness 20 consists of an adjustable belt 100 capable of fitting various waist sizes. An attachment belt portion 102 is connected to belt 100 and engages connecting rings 104 when belt 100 is fitted onto a trampoline user. Belt portion 102 preferably includes a section 106 comprised of "velcro" material known in the art. To secure belt 100 onto the trampoline user, belt portion 102 is slipped into both rings 104, folded back, and securely attached to a "velcro" portion 108 on belt 100. "Velcro" portion 108 corresponds to "velcro" section 106 to ensure a strong connection. Preferably, belt 100 has a width of three inches and includes a ¼ inch thick section of soft material, for example felt, attached to the inside of belt 100 for added comfort.

Harness 20 further includes a pair of leg attachments 110 for attachment to the legs of the trampoline user. Leg attachments 110 loosely loop around belt 100 to permit sliding around belt 100 and proper positioning of the attachment 110 with respect to the user's legs and regardless of the user's waist size.

Each leg attachment includes a leg strap 112 securely connected at the bottom of attachment 110. Each leg strap 112 includes a pair of corresponding "velcro" sections 114 and 116 to securely hold the upper thigh of the trampoline user and adjust to the size of the user's thighs.

A pair of flexible cords 66 connect to and swivel from harness 20 at points A, as shown in FIG. 3. Cords 66 each include a quick release swivel that connects to and swivels from rings 118 shown in FIG. 5. Rings 118 connect to leg attachments 110. Cords 66 are, preferably, commercially available "bunji" cords of about 5' in length. Rope 68 connects to and swivels from flexible cords 66 at points B. Rope 68 includes a metal bushing insert at its end to connect to a swivel connector of cord 66. Preferably, rope 68 is comprised of nylon or another suitable material of similar strength.

Ropes 68 wrap around a pair of pulleys that aid in hoisting the trampoline user. The shaft of a single pulley 60 inserts through holes in pipe 48 and socket 56 in the upper left hand corner of the tower 18 shown in FIG. 3. Similarly, the shaft of a double pulley 62 inserts through holes in pipe 48 and socket 56 in the upper right hand corner. The shafts of the pulleys are then securely bolted to tower 17.

One rope 68 first wraps around pulley 60, traverses the top of tower 18 and wraps around double pulley 62 to a winch 70. The other rope 68, on the right hand side of FIG. 3, wraps around double pulley 62 to winch 70. Winch 70 is used to raise or lower the user of the trampoline. Winch 70 connects to one side 40 by any suitable means, for example bolting at the top and bottom of winch 70.

It will be apparent to those skilled in the art that various modifications and variations can be made in the adjustable trampoline support of the present invention and in construction of this trampoline support without departing from the scope or spirit of the invention. For example, the adjustable trampoline support described herein can be used as a free standing device without a trampoline. In this case, support 16 shown in FIG. 3 may be used without trampoline 12 for various training and exercise routines. Preferably, frame 14 is used in combination with support 16 for added stability.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A trampoline system comprising:

a trampoline having a frame; and an adjustable support for supporting a user of the trampoline, the support having a tower adjustable to the dimensions of the frame and a harness attached to the tower for carrying the user, the tower including a pair of sides, a bottom, and a top connecting the pair of sides, wherein the top and the bottom are adjustable to the dimensions of the frame.

2. The trampoline system of claim 1, wherein a height of the tower adjusts to accommodate a size of the user.

3. The trampoline system of claim 2, wherein the pair of sides each include telescoping piping to adjust the height of the tower.

4. A trampoline system comprising:

a trampoline having a frame; and an adjustable support for supporting a user of the trampoline, the support having a tower adjustable to the dimensions of the frame and a harness attached to the tower for carrying the user, the tower including a top adjustable to the dimensions of the frame, wherein the top and a bottom of the tower each include telescoping piping to adjust a width of the tower to the dimensions of the frame.

5. The trampoline system of claim 1, further comprising a pair of cords connecting the harness to the tower.

6. The trampoline system of claim 5, further comprising a winch connected to the pair of cords for hoisting the user of the trampoline.

7. The trampoline system of the claim 5, wherein at least a portion of each of the pair of cords includes a flexible cord section.

8. The trampoline system of claim 1, further comprising braces connecting the tower to the frame for stabilizing the support.

9. A trampoline system comprising:

a trampoline;

a tower having a top, a bottom, and a pair of sides, wherein each of the top and the bottom connects the pair of sides and is adjustable to the dimensions of the trampoline; and a harness attached to the top of the tower for carrying a user.

10. The trampoline system of claim 9, wherein the pair of sides of the tower adjust to accommodate a size of the user.

11. The trampoline system of claim 10, wherein the pair of sides include telescoping piping to adjust a height of the tower.

12. The trampoline system of claim 9, wherein the top and the bottom of the tower each include telescoping piping to adjust a width of the tower to the dimensions of the trampoline.

13. The trampoline system of claim 9, further comprising a pair of cords connecting the harness to the tower.

14. The trampoline system of claim 13, further comprising a winch connected to the pair of cords for hoisting the user of the trampoline.

15. A trampoline system comprising:

a trampoline;

a tower having a top portion, a bottom portion, and a pair of sides connected by the top portion, a height of the pair of sides being adjustable to accommodate the size of a user, and a width of the top portion and the bottom portion being adjustable to a size of the trampoline; and a harness connected to the top portion for carrying the user.

16. The trampoline system of claim 15, wherein the pair of sides include telescoping piping to adjust the height of the tower.

17. The trampoline system of claim 15, wherein the top portion includes telescoping piping to adjust the width of the tower to the dimensions of the trampoline.

18. A trampoline system comprising:

a trampoline;

an adjustable support having a top portion and a bottom portion each adjustable in length to fit the dimensions of the trampoline;

the adjustable support further including a pair of sides adapted to be connected to the top and bottom portions, a height of the pair of sides being adjustable to accommodate a size of a user; and a harness adapted to be connected to the top portion for carrying the user.

19. The trampoline system of claim 18, wherein the top portion and bottom portion each includes telescoping piping to adjust a width of the support to the dimensions of the trampoline and to increase the portability of the support.

20. The trampoline system of claim 18, wherein each of the pair of sides includes telescoping piping to adjust the height of the support to the size of the user and to increase the portability of the support.

* * * * *